US005904419A

United States Patent [19]

Arribau

[11] Patent Number: 5,904,419

[45] Date of Patent: May 18, 1999

[54] BLENDER METHOD AND APPARATUS

[76] Inventor: Jorge O. Arribau, 1552 E. Girard Pl., No. 914, Englewood, Colo. 80110-9215

[21] Appl. No.: 08/902,316

[22] Filed: Jul. 29, 1997

[51] Int. Cl.[6] ..... B01F 5/16

[52] U.S. Cl. ..... 366/167.2; 366/264; 366/263

[58] Field of Search ..... 366/172.1, 163.2, 366/164.1, 164.6, 167.2, 181.8, 182.2, 190, 262, 263, 264, 265

[56] References Cited

U.S. PATENT DOCUMENTS

| | | | |
|---|---|---|---|
| 742,385 | 10/1903 | Blaisdell . | |
| 2,882,149 | 4/1959 | Willems . | |
| 3,256,181 | 6/1966 | Zingg et al. . | |
| 3,355,106 | 11/1967 | Graham | 366/167.2 |
| 3,606,270 | 9/1971 | Zimmerly | 366/263 |
| 3,669,414 | 6/1972 | Love . | |
| 3,820,759 | 6/1974 | Hege | 366/265 |
| 3,845,938 | 11/1974 | Schold . | |
| 4,305,673 | 12/1981 | Herbst | 366/343 |
| 4,347,004 | 8/1982 | Platts | 366/137 |
| 4,534,657 | 8/1985 | Clement | 366/265 |
| 4,614,435 | 9/1986 | McIntire | 366/40 |
| 4,628,391 | 12/1986 | Nyman et al. | 366/265 |
| 4,671,665 | 6/1987 | McIntire | 366/40 |
| 4,808,004 | 2/1989 | McIntire et al. | 366/155 |
| 4,834,542 | 5/1989 | Sherwood | 366/21 |
| 4,838,701 | 6/1989 | Smith et al. | 366/136 |
| 4,850,704 | 7/1989 | Zimmerly et al. | 366/263 |
| 4,893,941 | 1/1990 | Wayte | 366/265 |
| 5,046,856 | 9/1991 | McIntire | 366/291 |
| 5,322,357 | 6/1994 | Mazer | 366/263 |

FOREIGN PATENT DOCUMENTS

| | | | |
|---|---|---|---|
| 302859 | 10/1965 | Netherlands | 366/167.2 |

*Primary Examiner*—Tony G. Soohoo
*Attorney, Agent, or Firm*—John E. Reilly

[57] ABSTRACT

A blender apparatus specifically adaptable for intermixing solid and liquid materials is made up of a housing for an impeller assembly having upper and lower impeller portions and wherein liquid directed into the lower impeller portion is redirected axially into the upper impeller portion for intermixing with solid materials directed into the upper impeller portion and undergo outward radial movement through the upper impeller portion into an outer peripheral area surrounding the impeller portions for subsequent discharge therefrom.

30 Claims, 2 Drawing Sheets

BLENDER METHOD AND APPARATUS

BACKGROUND AND FIELD OF INVENTION

The invention relates to a method and apparatus for mixing together liquid and solid constituents, and more particularly to a novel and improved method and apparatus for high-capacity blending of solid particles and liquids, and specifically relates to a centrifugal pump blender for optimizing continuous, high-volume mixing of a granular or particulate solid with a liquid.

The invention is directed to certain improvements in a mechanical blender, and is particularly useful in oil and gas well field activities where thorough intermixing and rapid discharge of high volumes of solid and liquid components often is necessary, such as, in subsurface fracturing and down-hole cementing operations. Large volume blenders are generally of two basic types, "batch" mixers and "continuous" mixers. Batch mixers, in which large volumes of admixtures are agitated together, have generally passed from the scene owing to their need for a large mixing reservoir, which severely impacts portability, and also because they do not readily permit rapid changes in the characteristics of the mixture produced.

Presently more common are continuous mixing devices. One type of continuous mixer known in the art has two impellers coupled upon a single vertical drive shaft and within a generally cylindrical casing or housing. The upper impeller, commonly called a "slinger" or "thrower," receives granular, particulate or pulverous solids material at its center by a simple gravity feed straight down through a centrally located hole in the upper casing. The upper thrower, when spinning upon the shaft, projects the solid material toward a peripheral zone beyond the circumference of the impeller. Liquid is pumped or otherwise introduced through an opening in the lower housing and is pushed by centrifugal force generated by the lower rotor or impeller to the peripheral zone. Mixing of the solids and liquid occurs primarily in the peripheral zone between the two impellers and beyond their peripheries after which the mixture is forced through a discharge outlet in the housing.

An aspect common to most prior art devices is the creation of a gradient of increasing pressure from the central axis of rotor rotation outwardly toward the peripheral zone, the peripheral zone manifesting the highest pressures within the housing. Consequently, once liquid or solid materials are forced into the peripheral zone, intimate mixing occurs rapidly therein; however, the same high pressures which promote thorough mixing of materials in the peripheral zone also impede the introduction therein of additional materials, particularly liquids, to be mixed.

U.S. Pat. No. 3,256,181 to Zingg et al shows a mixer incorporating a centrifugal pump with a double-faced, shaft-mounted impeller whereby solid particulate and liquid components are initially commingled, as well as mixed, in the peripheral zone. U.S. Pat. Nos. 4,614,435 and 4,671,665 to McIntire teaches a machine for mixing solids and liquids including a solids slinger element mounted directly above a liquid impeller element, the slinger and impeller being mounted upon a vertical rotatable shaft. Solids dropped onto the central portion of the slinger are moved by centrifugal force to a peripheral zone and there mixed with a liquid pumped into the housing by the impeller. Initial commingling of solids with liquids occurs in the peripheral zone. U.S. Pat. No. 4,808,004 to McIntire et al shows a shaft-mounted rotating slinger for introducing solid particles into a blender, while a separate centrifugal pump is used to inject liquids into the blender housing and into the peripheral zone.

U.S. Pat. No. 4,834,542 to Sherwood discloses an apparatus similar to the devices taught by McIntire, with a liquid impeller and a solids slinger mounted upon a common shaft, and including a hopper for introducing particulates non-centrally to the slinger and a disturber element for creating a low-pressure mixing zone where the particulates are introduced.

Despite the efforts represented by the foregoing patents, the entire disclosures of which are incorporated herein by reference, a need remains for a double-faced impeller mixer which permits initial commingling of solids and liquids in a zone of reduced pressure, and yet exploits the beneficial mixing effects of a high pressure peripheral zone. There also remains a need for a centrifugal type blender with a slinger or thrower portion which utilizes gravity in part to promote movement of solid particles to a mixing zone, rather than relying exclusively upon centrifugal force to move solid particles. Against this background, and to meet the described need and to proffer other advantages over the known art, the following invention was developed.

SUMMARY OF THE INVENTION

It is therefore an object of the invention to provide for a novel and improved method and apparatus for intermixing fluid and solid materials and particularly liquid/solid materials; and specifically wherein the blender is characterized by being extremely compact and capable of continuously intermixing high volumes of such materials and discharging same to another site.

Another object of the present invention is to provide for a novel and improved blender apparatus characterized by having superimposed impeller zones so constructed and arranged as to promote highly efficient mixing and flow of the materials.

It is a further object and feature of the present invention to establish intimate mixing of solids and liquids in a zone of reduced pressure preliminary to flow into a high pressure discharge zone; and further wherein gravity is utilized to assist in advancing the solid particles through an impeller region in cooperation with a rotating impeller assembly.

It is still another object of the present invention to provide for a novel and improved blender apparatus for rapidly and thoroughly intermixing solid and liquid materials prior to introduction into a peripheral discharge zone.

In accordance with the present invention, there has been devised an apparatus for mixing materials comprising a housing having an outer peripheral space therein, means for introducing a first material into the housing, means for introducing a second material into the housing, a shaft disposed for powered rotation within the housing, a rotor mounted upon the shaft for rotation within the housing with the peripheral space being defined between the housing and rotor, and the rotor having upper and lower impeller portions for each of the respective first and second materials, and means for directing the second material axially from its impeller portion into the upper impeller portion for the first material whereby to intermix the materials for outward radial movement into the peripheral space when the rotor is rotated. Preferably, the first material comprises solid particles and the second material comprises liquid which either is pumped or drawn into the lower impeller portion and then redirected axially into the upper impeller region for intermixing with the solid particles prior to advancement into the outer peripheral space; and the rotor is mounted at an angle to horizontal such that solid materials introduced through a solids inlet into the solids impeller will fall by gravity in a radial outward direction toward the outer peripheral space thereby reducing the rotational force or energy necessary to advance the solid materials through the impeller region into the peripheral space and eliminating any tendency of the solid materials to accumulate at the eye of the impeller as a result of the change of direction in velocity of the solids from vertical to horizontal. Furthermore, the impeller regions or zones for the respective solid and liquid materials are so proportioned that the solids impeller region has a greater capacity than that of the liquids impeller region, although the relative size or capacity between the impeller regions may vary with the nature of the materials being intermixed.

The above and other objects of the present invention will become more readily appreciated and understood from a consideration of the following detailed description of preferred and modified forms of the present invention when taken together with the accompanying drawings in which:

DETAILED DESCRIPTION OF A PREFERRED EMBODIMENT

The invention relates to a blender apparatus preferably for mixing particulate, pulverous, or granular solids with a liquid. The principal beneficial use contemplated for the invention is in oil and gas well operations, such as, in fracturing or cementing activities. In such field operations, it frequently is necessary to rapidly and continuously mix large volumes of solid powders or particulates, such as, cements, sand and the like with liquids, such as, water or gels for injection under pressure down the well bore. The present invention provides means for rapidly and thoroughly mixing solid particles with liquids for delivery under pressure to the well head. To provide for the portability of the invention from well to well, the apparatus may be, but is not necessarily, truck-mounted; and it will be appreciated that the invention may find beneficial application outside the field of oil and gas well activities.

Figure 1:
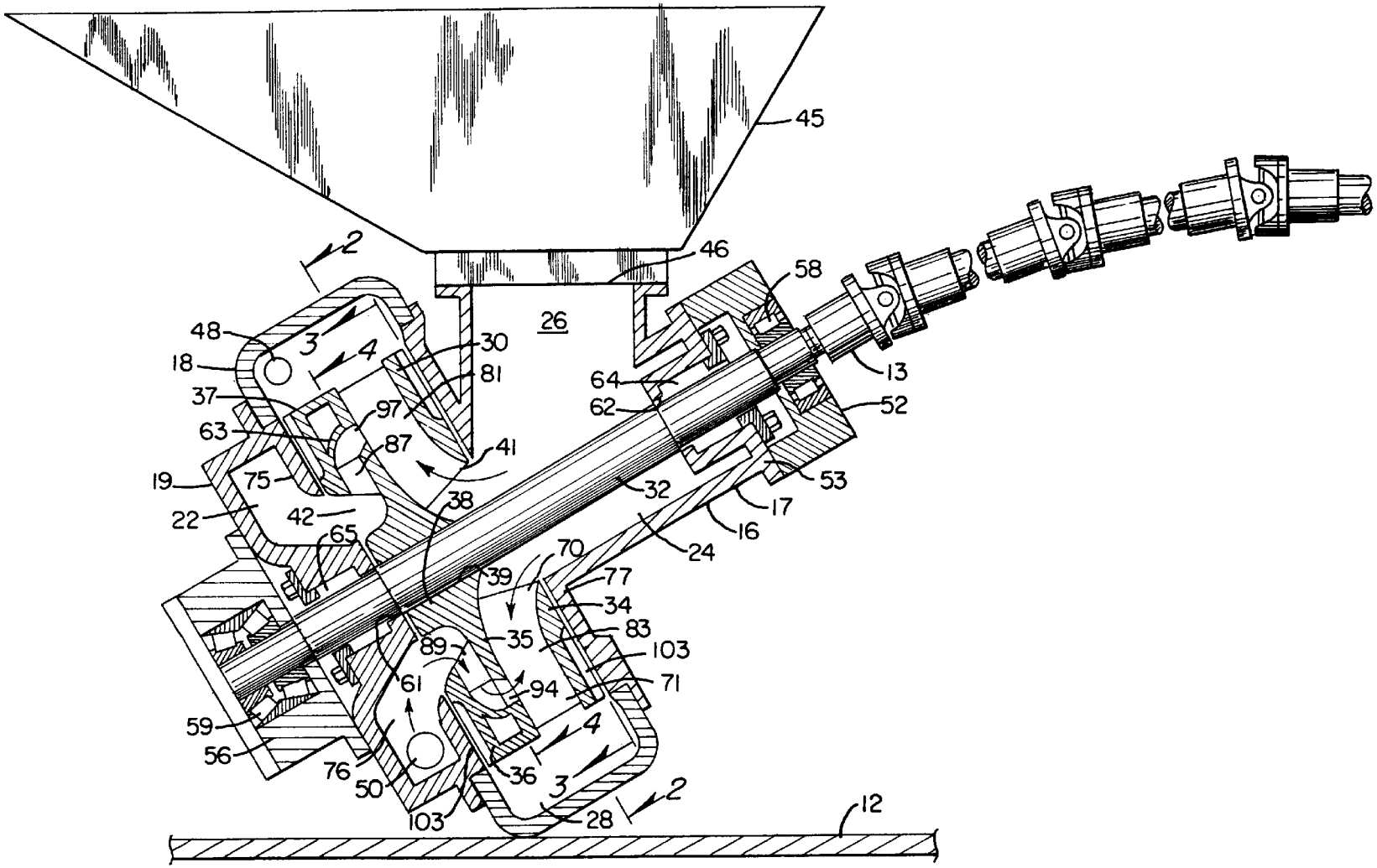
FIG. 1 is a side view partially in section of a preferred embodiment of the invention, the section taken substantially vertically through the longitudinal axis of the invention.

A preferred embodiment of the blender apparatus of the invention is shown in FIG. 1. The blender apparatus is generally indicated by reference numeral 10 and includes a housing 16 fixedly connected to a generally cylindrical base 19. Blender 10 optionally is mounted upon the transportation bed 12 of a service vehicle (not shown) to provide apparatus mobility. The longitudinal axis of the blender 10 is tilted from the horizonal and so positioned as to be compact in the vertical as well as horizontal dimensions to promote portability upon a truck, or to permit two blender units 10 to be juxtaposed on an eight-foot wide truck bed 12. The housing 16 may be made of two or more parts to provide for ease of manufacture and assembly, and preferably comprises an upper cylindrical portion 17 and a lower cylindrical portion 18 of increased diameter to contain a generally cylindrical rotor or impeller assembly 30. The impeller assembly 30, to be described in detail, is keyed to shaft 32 for coaxial rotation within the lower portion 18. Housing 16 may be of unitary construction, or, as shown in FIG. 1, comprise separately manufactured lower portion 18 and upper portion 17 rigidly connected together, such as by immobile retention of the lower portion 18 between the upper portion 17 and the base 19.

The impeller assembly 30 features on its upper side a thrower or upper impeller portion which receives particulate material at its common center by gravity feed through an eye between the upper and lower portions 17, 18 of the housing 16 and which projects the solids towards a peripheral space 28 in the lower portion 18. The lower side of the impeller assembly 30 comprises a lower impeller portion which draws liquid through an eye in the base 19 for delivery by centrifugal force to the thrower portion of the impeller assembly 30 where mixing of solids and liquids is initiated. In the preferred embodiment, the lower impeller portion and upper thrower portion of the impeller assembly 30 are axially superimposed to constitute the integral impeller assembly 30, but it will be appreciated by those of ordinary skill in the art that the upper and lower impeller portions may in alternative impeller assembly embodiments be spaced somewhat apart but generally would not be as compact and efficient.

Thorough mixing of the granular solids and the liquid occurs in the peripheral space 28 in the lower portion 18, and the mixture is then drawn off through a mixture outlet 48 in the lower portion 18. When the impeller assembly 30 is rotated at the high speeds (e.g. approximately 1,000 rpm) characteristic in the art for centrifugal mixing, the lower portion 18 generally acquires an inner zone subject to approximately atmospheric pressure, with pressures increasing proceeding radially outwardly to the peripheral space 28 where pressure is the greatest.

Upper portion 17, lower portion 18 and base 19 along the impeller assembly 30 are serially connected along a common longitudinal axis which, as evident in FIG. 1, preferably is tilted at an angle from the horizontal, for example, at an acute angle in relation to the truck bed 12. The entire blender assembly 10 is generally radially symmetrical about the central longitudinal axis, excepting the provision of a hopper 45 and solids inlet 26 projecting from the top of the blender 10.

The upper portion of housing 16 defines and substantially encloses an interior space 24. The hollow lower portion 18 extends radially beyond the periphery of the impeller assembly 30 to define a generally toroidal peripheral space 28 about the circumference of the impeller assembly 30. The lower portion 18 is provided with a mixture outlet 48 by which the mixed solids and liquids may be expelled from the peripheral space 28 by the action of the impeller assembly 30, as further described herein. The base 19 defines therein an annular shaped space 22 and is provided with an inlet 50 whereby a liquid is pumped to the space 22. The inlet 50 is positioned so that liquid is introduced substantially tangentially into the space 22.

The hopper 45 is generally funnel-shaped for the introduction of solid particulate or pulverous matter, such as, cement or sand through the upper portion 17 of housing 16. The bottom end 46 of the hopper 45 is in communication with the solids inlet 26 provided in the upper portion 17. The outlet end 46 of the hopper 45 may be provided with a butterfly or slide valve, not shown, according to known practices for controlling the flow of solids from the hopper 45 into the solids inlet 26 on housing 16. Solids inlet 26 is a generally tubular opening in liquid communication with the interior space 24 and extending from the upper portion 17 at an oblique angle so that when the longitudinal axis of the housing 16 is disposed at a preferred angle of between approximately 30° and 60° from horizontal, the axis of the solids inlet 26 is substantially vertical, as indicated in FIG. 1. Sand or other particulate solids from the hopper 45 pass by gravity into the interior space 24 and somewhat in an outward radial direction into the impeller assembly 30.

The impeller assembly shaft 32 is journaled for rotation concentrically within the housing 16 by upper and lower bearings 58, 59 contained within upper cap 52 and lower cap 56 secured to the top wall 53 of upper portion 17 and the base 19, respectively. The shaft 32 accordingly runs the complete length of the housing 16. The shaft 32 extends through a central base bore 61 in the base 19 and through upper bore 62 in upper portion 17, and to the exterior of the housing 16 for operative connection to a drive shaft 13 connected to a source of rotary power, such as, a take-off from the power transmission train of the truck, not shown. Upper and lower packing glands or seals, not shown, but positioned in the recesses 64, 65 provide a seal between the drive shaft 32 and the upper portion 17 and base 19, thereby barring liquid communication between the interior space 24 and the exterior of housing 16 via the upper bore 62, or between the base space 22 and the exterior of the base 19 via the base bore 61. Because the impeller assembly shaft 32 is driven from the top, the upper bearing 58 and its packing operate at about one atmosphere of pressure. In contrast, because the impeller portion of the impeller assembly 30 when rotated generates a suction to pull liquid from the interior space 22 of the base 19, the bottom seal operates under pressures varying from in excess of minus one atmosphere up to the maximum head in the housing 16.

The top wall 75 of the base 19 has an annular opening 76 disposed substantially concentrically around the longitudinal axis of the blender 10. Annular opening provides for liquid communication between the space 22 within the base 19 and the hollow interior of the lower portion 18 of the housing 16. Accordingly, water or other liquid introduced through the liquids inlet 50 may flow to the peripheral space 28 within the lower portion 18 by operation of the impeller assembly 30.

Continuing reference to FIG. 1, the axial dimension of the impeller assembly 30 is somewhat less than the axial dimension of the interior space of the lower portion 18, so that the impeller assembly 30 fits inside the lower portion 18 in closely axially spaced apart relation between flange 77 and base 19. Impeller assembly 30 broadly comprises a generally frusto-conical cover plate 34, central plate 35, and generally planar bottom plate 36 in serially spaced apart relation. The plates 34, 35, 36 are generally mutually parallel, with the distance of separation between the cover plate 34 and the central plate 35 substantially greater than the separation distance between the bottom plate 36 and the central plate 35. For example, the cover plate 34 is spaced approximately one-and-one-half to two times farther from the central plate 35 than the bottom plate 36 is spaced from the central plate 35. Thus, the volume between the cover plate 34 and the central plate 35 is between about 120% and 200% and preferably about 120% greater than the volume between the bottom plate 36 and the central plate 35.

As best indicated by FIG. 1, the radially interior part of the central plate 35 defines an enlarged hub 38 providing structural strength for the impeller assembly 30. The hub 38 has a central bore 39 to receive the impeller assembly shaft 32 and is keyed to the shaft 32 to position the impeller assembly 30 within the lower portion 18 and prevent significant axial shifting of the impeller assembly 30 within the housing 16 as it is rotated by the drive shaft 13. The central plate 35 is substantially planar, but includes a concave surface in the vicinity of the hub 38 whereby to add further axial extent to the hub and also to efficiently direct materials radially and outwardly from the upper portion 17 to the lower portion 18 of the housing 16, as described hereinafter.

The cover plate 34 has a generally circular, centrally located aperture 41 which has a diameter significantly larger than the diameter of the shaft 32 to provide liquid communication past the shaft 32 axially between the interiors of the upper and lower portion 17, 18 of the housing 16. As depicted in FIG. 1, the diameter of the cover plate aperture 41 corresponds generally to the interior diameter of the upper portion 17. In the preferred embodiment, the cover and central plates 34, 35 have substantially equal outside diameters so as to have peripheral edges approximately equidistant from the longitudinal axis of the blender 10.

The bottom plate 36 is a generally planar annular disk attached to the central plate 35 by outer wall 37. The hub 38 and the radial interior of the bottom plate 36 define a concentrically disposed annular aperture 42 therebetween for liquid communication between the interiors of the base 19 and the lower portion 18 of the housing 16. As shown in FIG. 1, the radial extent of the base plate aperture 42 preferably corresponds to the radial extent of the annular opening 76 in the top of the base 19, so that the solid portion of the bottom plate 36 does not cover any part of the opening 76 in the base 19.

Figure 2:
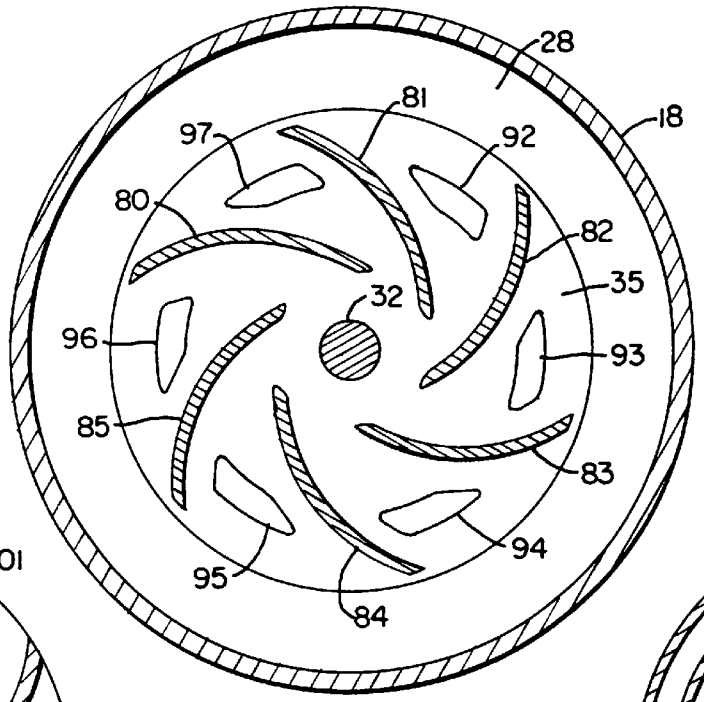
FIG. 2 is a cross-sectional view taken substantially along line 2—2 in FIG. 1.

Combined reference is made to FIGS. 1 and 2. The cover plate 34 and the central plate 35 are connected in spaced relation by a plurality of radial thrower vanes 80–85 in equally spaced circumferential relation to one another. The vanes 80–85 are perpendicularly disposed between the generally parallel cover plate 34 and central plate 35 and are substantially identical to each other and each is configured to present a curved horizontal cross section as shown, the convex surface of each vane 80–85 defining the leading surface of the vane as the impeller assembly 30 rotates in a clockwise direction as shown in FIG. 2. Each of the thrower vanes 80–85 is mounted at a skewed position with respect to the longitudinal axis of the blender 10, so that the radially interior edge of each vane is fixed in a circumferentially advanced position in the direction of rotation with respect to the vane's exterior edge, to define the balanced volute array of vanes seen in FIG. 2. Alternatively, the vanes 80–85 may be substantially planar and angularly disposed in a similar skewed position upon the central plate 35. As seen in FIG. 1, the thrower vanes 80–85 extend substantially the entire radial distance from the aperture 41 to substantially proximate to the periphery of the cover plate 34, and from the vicinity of the hub 38 to the periphery of the central plate 35. In the embodiment illustrated by FIG. 2, the thrower vanes 80–85 are six in number, regularly spaced circumferentially about the central plate 35. Alternative embodiments may employ other, preferably even, numbers of equidistantly spaced thrower vanes 80–85. As indicated in FIGS. 1 and 2, passageways are defined between adjacent ones of the thrower vanes 80–85 to extend radially outward from the interior edge of the cover plate 34 toward the peripheral edges of the cover and central plates 34, 35.

Figure 4:
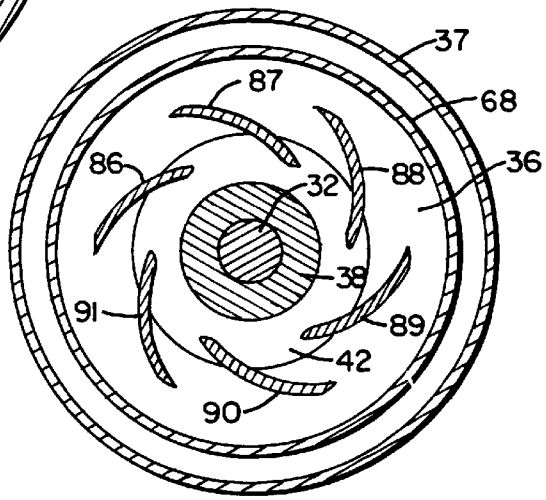
FIG. 4 is a cross-sectional view taken substantially along line 4—4 in FIG. 1.

The bottom plate 36 and central plate 35 are held together in spaced parallel relation by the substantially cylindrical outside wall 37 and by a plurality of uniformly disposed radial impeller vanes 86–91 (FIG. 4). An annular deflector ring 68 is disposed between the bottom plate 36 and central plate 35 and has an arcuate cross-section, as shown in FIG.

1, with its concave surface in facing relation to liquid flow in order to redirect radial liquid flow in the passageways between the vanes 86–91 to flow axially and upwardly through slots or apertures 92–97 in the central plate 35 in a manner to be further described. The impeller vanes 86–91 are uniformly spaced and perpendicularly disposed between the substantially parallel bottom plate 36 and central plate 35. The individual impeller vanes 86–91 preferably are substantially identical to one other and, similarly to the thrower vanes 80–85, preferably are configured to present a curved or spiral horizontal cross section as shown in FIG. 4; further, each of the impeller vanes 86–91 presents a convex surface facing toward the direction of impeller assembly rotation, i.e., clockwise in FIG. 4. Each of the impeller vanes 86–91 is mounted between the plates 35, 36 in a skewed or angled disposition respecting the axis of the blender 10 to define the spiral pattern seen in FIG. 2. In the embodiment illustrated by FIG. 2, the impeller vanes 86–91 number six, although alternative embodiments may employ other, preferably even, numbers of vanes but most preferably equaling the number of thrower vanes 80–86 employed. Preferably, the impeller vanes 86–91 are skewed at a greater angle than the vanes 80–85 to encourage the liquid flow outwardly against the deflector ring 68.

As seen in FIG. 1, the impeller vanes 86–91 preferably extend from the radially interior edge of the bottom plate 36 defining the aperture 42 radially outward to the mixing apertures 92–97 in the central plate 35. As indicated in FIGS. 1 and 4, the impeller vanes 86–91 define therebetween a plurality of passageways for liquid communication between the bottom plate aperture 42 and the mixing apertures 92–97. Preferably, impeller vanes 86–91 are substantially smaller than the thrower vanes 80 to 85 so that the liquid is diverted into the upper thrower passageways under just enough pressure to intermix with the solid materials and to flow outwardly with the solid materials. Otherwise, if the liquid pressure is unduly high, it may tend to flow radially inwardly counter to the outward flow of solid materials. As a result, the impeller vanes 86 to 91 are much shorter and narrower than the thrower vanes 80 to 85.

Returning attention to FIG. 2, the mixing apertures 92–97 are preferably disposed in a circular array in the central plate 35 concentrically about the longitudinal axis of the blender 10. Each of the mixing apertures 92–97 is located between adjacent pairs of the vanes 80–85, with each mixing aperture 92–97 preferably being spaced equidistantly from its adjacent vanes 86–91. Because the vanes 80–85 are aligned axially with the impeller vanes 86–91, the mixing apertures 92–97 also are uniformly situated between the impeller vanes, so that the passages between the impeller vanes are in liquid communication with the passages between the thrower vanes 80–85 via the mixing apertures. Preferably, the number of mixing apertures 92–97 is equal to the number of throwing vanes 80–85, although alternative embodiments may incorporate a larger number of mixing apertures 92–97, with more than one mixing aperture disposed between pairs of thrower vanes. As indicated by FIG. 2, the mixing apertures 92–97 preferably have an irregular, somewhat trapezoidal or teardrop-like shape, presenting the larger end of each aperture in the direction of impeller assembly rotation. Also as best depicted in FIG. 2, the mixing apertures 92–97 are disposed a radial distance from the longitudinal axis of the blender 10, the distance preferably equaling between about one-half and about three-fourths of the radius of the central plate 35.

I have determined that by disposing the mixing apertures 92–97 at a radial distance from the shaft 32 of from about one-half to three-fourths the radius of the central plate 35, by separating the cover plate 34 from the central plate a greater distance than the distance separating the bottom plate 36 from the central plate, and by providing the thrower vanes 80–85 with a substantially greater radial extent than the radial extent of the impeller vanes 86–91, the vanes 86–91 will impart sufficient energy to the liquid flowing through the impeller passageways to force the liquid through the mixing apertures without significantly disturbing the radially outward movement of the solid particles in the impeller assembly 30. The liquid thus passes through the mixing apertures 92–97 with enough energy to mix with the solids, but without sufficient momentum to flow radially inwardly within the impeller assembly passageways rather than toward the peripheral space 28. This provides the advantage of initially commingling the liquid with the solid particles at a low pressure prior to their movement into the high pressure peripheral space 28. The blender 10 consequently can be operated with less horsepower, but with little or no reduction in mixing efficiency; energy ordinarily expended to force the liquid constituent directly into the high pressure peripheral space 28 is conserved, yet thorough mixing of liquids and solids is realized within the peripheral space 28 prior to expulsion through the mixture outlet 48 in communication with the peripheral space.

Figure 3:
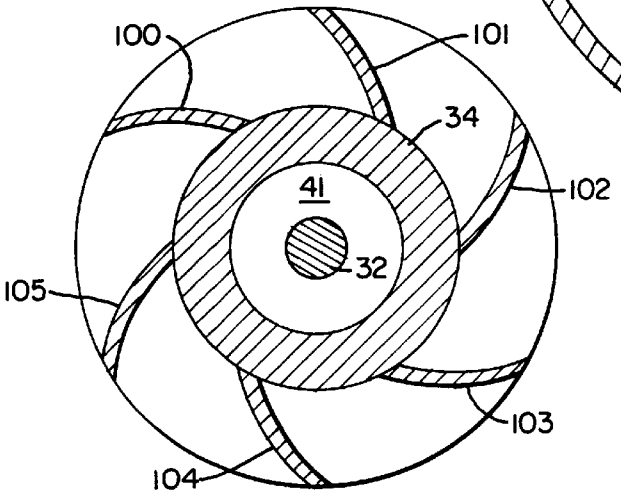
FIG. 3 is a cross-sectional view taken substantially along line 3—3 in FIG. 1.

As shown in FIGS. 1 and 3, the top surface of the cover plate 34 is provided with shallow expeller vanes 100–105 which are uniformly spaced and project perpendicularly from the upper surface of the cover plate 34. The expeller vanes 100–106 preferably are substantially identical to one other and, similarly to the vanes 80–85, are configured to present a curved or spiral horizontal cross section as shown in FIG. 3 to prevent inward radial flow of the liquid/solid mixture in the space 28. Preferably, each of the expeller vanes 100–105 presents a convex surface facing in the direction of impeller assembly rotation, i.e., clockwise in FIG. 3 and is disposed upon the cover plate 34 in a skewed position with respect to the axis of the blender 10 to define the spiral array seen in FIG. 3.

As further seen in FIGS. 1 and 3, the expeller vanes 100–105 preferably extend beyond the outer radial edges of the vanes 80–85 from a radially interior top portion of the cover plate 34 radially outward to the peripheral edge of the cover plate 34. Expeller vanes 100–105 act when the impeller assembly 30 is rotated to direct liquids in the peripheral space 28 radially outward, away from the top of the cover plate 34, thereby preventing inward leakage between the impeller assembly 30 and the top 77 of the lower portion 18 of the housing 16 and promoting mixture agitation in the peripheral space 28. A corresponding series of expeller vanes to the expeller vanes 100–105 are mounted on the undersurface of the plate 36, one of the vanes being illustrated at 103' in FIG. 1, to prevent inward leakage between the plate 36 and top wall 75 of the base.

The apparatus of the present invention may be operated to mix solids and liquids for injection down-hole in an oil or gas well for secondary recovery operations and the like. At the initiation of operation, a motive drive source rotates the drive shaft 13 and the impeller assembly 30 comprising the integrated thrower portion and impeller portion. As FIG. 1 illustrates, the drive shaft 13 may be connected to an articulated power train comprising a series of shafts interconnected by a series of universal joints to provide for the transmission of rotary power through the arc from a horizontal drive shaft (not shown) to the inclined drive shaft 13. As the impeller assembly 30 is in motion, the desired quantity of solids is dropped from the hopper 45 through the solids inlet 26 so as to flow substantially continuously through the interior space 24 in the housing 16. As indicated by the directional arrows in FIG. 1, the solids flow by gravity from the interior space 24 through the aperture 41 in the cover plate 34 and into the passages between the vanes 80–85 as they are forced outwardly by centrifugal force, and thus move radially between the thrower vanes 80–85 and are propelled into the peripheral space 28.

The movement of the solids from the hopper 45 to the peripheral space 28 is promoted by a feature of this invention: Many known centrifugal blenders utilize vertically mounted shafts, so that the impeller assembly rotates in a generally horizontal plane, and solids are dropped vertically onto the center of the impeller assembly. In such arrangements, movement of the solids from the center of the impeller assembly to the peripheral mixing areas is accomplished by centrifugal force only, which can slow mixing speeds and reduce mixing efficiencies. In noted contrast, the shaft 32 and overall axis of the present invention are canted at an angle, preferably between about 30° and 60° from horizontal. The impeller assembly 30 thus does not rotate in a horizontal plane, but instead rotates about the tilted shaft 32. As seen in FIG. 1, the solids inlet 26 preferably is located vertically above the aperture 41 in the cover plate 34, thus permitting solids to drop by gravity nearly directly downward from the hopper 45, past the shaft 32, through the aperture 41 toward the space 28. As the Figure illustrates, each passageway adjacent a vane (e.g. vane 83 in FIG. 1) has a radially interior entrance 70 in direct communication with the aperture 41 and also in communication with the passageway peripheral exit 71. Thus, a nearly straight, clear passage is defined vertically from the hopper outlet 46 through the interior space 24 and through the aperture 41 and interior entrance 70 into the passageway between any given pair of the vanes 80–85 which rotates into position within the low side of the lower portion 18 at a particular instant. It is seen therefore that because the impeller assembly is mounted upon the inclined shaft 32, as the impeller assembly 30 rotates the interior entrances 70 and peripheral exits 71 of the passageways between the various thrower vanes 80–85 consecutively come into substantial alignment beneath the solids inlet 26. As the impeller assembly 30 turns to locate consecutively the interior entrances 70 of the thrower passageways in substantially vertical alignment with the solids inlet, solid particles may fall by gravity from the hopper 45, through consecutive ones of the thrower passageways to the peripheral space 28.

Accordingly, in addition to centrifugal force, gravity causes movement of solids radially between the cover plate 34 and the central plate 35 along the passageways between adjacent vanes 80–85, as solids tend to fall straight down from the solids inlet 26, through the passageways between vanes 80–85, and to the lower reaches of the peripheral space 28. As the directional arrows of FIG. 1 indicate, however, centrifugal forces also drive solids radially outwardly and upwardly between the cover plate 34 and central plate 35 between the vanes 80–85 moving through the high side of the lower portion 18 of the housing 16. Overall mixing efficiency is increased by the invention's configuration whereby gravity promotes radially outward flow through the impeller assembly 30 between cover plate 34 and central plate 35. The need for sand augers or the like, commonly encountered in known devices for supplementing centrifugal force as a means for promoting movement of solid particulates past the thrower vanes, is eliminated as well as the need for a right angle drive and thereby increases the reliability of the system.

The liquid to be mixed is introduced into the interior space 22 of the base 19 by way of the liquids inlet 50. As the impeller assembly 30 rotates, the impeller vanes 86–91 rotate at the same angular velocity as the vanes 80–85. The vortex action of the impeller vanes 86–91 generates a suction force which assists in drawing the liquid through the opening 76 in the top wall 75 of the base 19, between the bottom plate 36 and the hub 38, and into the lower portion 18. As indicated by the directional arrows of FIG. 1, the vortex and centrifugal forces resulting from the rotary movement of the impeller vanes 86–91 pressurize and drive the liquid between the bottom plate 36 and central plate 35 and radially outward through the passageways between the impeller vanes 86–91.

An advantage of the invention is here manifest in that the liquid is not moved by centrifugal force immediately out to the high-pressure peripheral space 28, as frequently is the case with known blenders. Rather, the arcuate deflector ring 68 redirects the flow of the liquid to flow transversely across the path of travel of the solids, and the centrifugal forces imparted to the liquid by the impeller vanes 86–91 instead cause the liquid to flow axially through the mixing apertures 92–97 and into the space between the central plate 35 and the cover plate 34. In this manner, the liquid and solids come into initial contact in the passageways between the vanes 80–85. The passageways between the vanes 80–85 are areas of comparatively lower pressure than the pressures extant in the peripheral space 28. The invention thus avoids the physical difficulty of introducing a liquid into a high pressure peripheral space, as encountered in known devices.

Again, the vanes 86–91 are substantially smaller than the vanes 80–85, and are located radially inward from the mixing apertures 92–97. Consequently, the liquid is forced through the mixing apertures 92–97 with considerably less kinetic energy than the energy possessed by the solids moving rapidly past the thrower vanes 80–85. The liquids thus intermix with the solids without significantly altering or impeding the solids flow toward the peripheral space 28. However, because the passageways between the thrower vanes 80–85 are lower pressure areas, the liquids upon emerging from the mixing apertures 92–97 readily commingle with the solids while both liquids and solids move by centrifugal force through the passageways between the thrower blades 80–85 into the peripheral space 28 where thorough mixing rapidly occurs under higher pressure.

Mixture of solids and liquids continues within the peripheral space 28. The mixture is substantially continuously discharged under pressure via the mixture outlet 48 from the peripheral space 28 to the exterior of the housing 16. From the mixture outlet 48, the mixture may be conveyed to another unit, not shown, for injection in the well head and down the bore hole.

In the preferred embodiment, the impeller portion of the impeller assembly 30 serves to draw liquid, such as, water into the housing 16 and impel it through the mixing apertures 92–97 for mingling with the solid particles, such as, sand moving through the passageways between adjacent thrower vanes 80–85. For example, in the typical foam fracturing operation, sand is intermixed with water in the ratio of less than 17 lbs. of sand for each gallon of water; or, expressed another way, less than 32 lbs. of sand for each gallon of slurry discharged from the impeller housing. It will be apparent to one skilled in the art to which the invention pertains that serviceable alternative embodiments of the invention may incorporate the impeller assembly 30 featuring a functional thrower portion, but lacking any impeller vanes. In such alternative embodiments, separate external pumps may be employed in lieu of impeller vanes to impart energy to the liquid to force it through the mixing apertures 92–97 in the central plate 35.

It is therefore to be understood that while preferred forms and methods of the invention have been herein set forth and described, various modification and changes may be made in the construction and arrangement of parts, composition of materials, and order of steps without departing from the spirit and scope of the present invention as defined by the appended claims.

I claim:

1. Apparatus for mixing solid particles with a liquid comprising:

a housing having an outer peripheral space therein;

means for introducing solid particles into said housing;

means for introducing a liquid into said housing;

a shaft disposed for powered rotation within said housing;

an impeller assembly mounted upon said shaft for rotation within said housing, said peripheral space defined between said housing and said impeller assembly, and said impeller assembly having an upper solids thrower portion including thrower vanes therein and a lower liquids impeller portion including impeller vanes therein, said thrower vanes extending radially beyond said impeller vanes; and means for directing said liquid axially from said impeller portion to said portion between said shaft and said peripheral space whereby to intermix said liquid and solid particles for outward radial movement into said peripheral space when said impeller assembly is rotated.

2. Apparatus according to claim 1 wherein said impeller assembly comprises a central plate between said thrower portion and said impeller portion, said thrower portion comprises a plurality of radially disposed thrower vanes defining at least one radial thrower passageway therebetween, and said impeller portion comprises a plurality of radially disposed impeller vanes defining at least one radial impeller passageway therebetween.

3. Apparatus according to claim 2 wherein said liquid directing means includes at least one aperture through said central plate to establish liquid communication between said impeller passageways and said thrower passageways.

4. Apparatus according to claim 3 wherein said impeller assembly further comprises a cover plate in spaced parallel relation to said central plate, a bottom plate in spaced parallel relation to said central plate, and wherein said thrower vanes extend substantially perpendicularly between said cover plate and said central plate, and said impeller vanes extend substantially perpendicularly between said bottom plate and said central plate.

5. Apparatus according to claim 4 wherein said thrower vanes are of a width greater than that of said impeller vanes.

6. Apparatus according to claim 5 wherein said width of said thrower vanes is at least 120% greater than that of said impeller vanes.

7. Apparatus according to claim 6 wherein said thrower portion has a volume at least 120% greater than the volume of said impeller portion.

8. Apparatus according to claim 3 wherein said apertures are disposed at a radial distance from said shaft of from about one-half to about three-fourths the radius of said central plate.

9. Apparatus according to claim 8 wherein said thrower vanes have a radial extent substantially greater than the radial extent of said impeller vanes, and said impeller vanes are disposed radially inward of said apertures.

10. Apparatus according to claim 3 wherein said liquid-directing means includes an annular deflector ring disposed between said bottom plate and said central plate for redirecting liquid flowing radially in said impeller passageways in an axial direction through said apertures.

11. Apparatus according to claim 2 wherein said shaft is disposed at an angle from horizontal, and each of said thrower passageways has a radially interior entrance, and wherein said impeller assembly is rotatable to locate consecutively said interior entrance in substantially vertical alignment with said solid particles introducing means whereby solids fall by gravity from said solid particles introducing means through consecutive ones of said thrower passageways.

12. Blender apparatus for mixing solid particles with a liquid comprising:

a housing having a radially inner solids inlet and a radially outer peripheral space therein provided with an outlet;

a shaft disposed symmetrically in said housing at an acute angle to horizontal for powered rotation within said housing; and an impeller assembly mounted upon said shaft for rotation within said housing, said impeller assembly having a solids thrower portion and a liquid impeller portion, said peripheral space defined between said housing and said impeller assembly, said thrower portion comprising a plurality of radially extending, circumferentially spaced thrower vanes defining a plurality of radial thrower passageways therebetween, said thrower passageways having a common radially inner entrance, and wherein said impeller assembly is rotatable to locate consecutively said thrower passageways in substantially vertical alignment below said solids inlet whereby solids may fall by gravity from said solids inlet through consecutive ones of said thrower passageways to said peripheral space.

13. Apparatus according to claim 12 wherein said housing comprises a substantially cylindrical upper portion having a common longitudinal axis with a substantially cylindrical lower portion, said lower portion having a diameter greater than said upper portion, and said lower portion containing said impeller assembly and said peripheral space.

14. Apparatus according to claim 13 wherein said shaft is disposed on said longitudinal axis and said solids inlet comprises a downwardly opening cylinder disposed substantially vertically upon a side of said upper portion.

15. Apparatus according to claim 14 wherein said impeller assembly further comprises a central plate between said thrower portion and said impeller portion, and said impeller portion comprises a plurality of radially disposed impeller vanes defining a plurality of radial impeller passageways therebetween, a cover plate spaced a first distance above said central plate, and a bottom plate spaced a second distance below said central plate, and wherein said thrower vanes extend substantially perpendicularly between said cover plate and said central plate, and said impeller vanes extend substantially perpendicularly between said bottom plate and said central plate.

16. Apparatus according to claim 15 wherein said cover plate has an aperture centrally therein and directly below said solids inlet in direct communication with said entrance.

17. Apparatus according to claim 15 further comprising a plurality of radially arranged expeller vanes disposed on said cover plate and said bottom plate.

18. Apparatus according to claim 15 further comprising liquid inlet means centrally located in said bottom plate for introducing liquids into said lower portion, wherein rotation of said impeller assembly draws the liquid axially through said inlet means and radially outwardly under centrifugal force toward said peripheral space.

19. Apparatus according to claim 15 further comprising means for directing the liquid from said impeller portion to said thrower portion between said shaft and said peripheral space.

20. Apparatus according to claim 19 wherein said liquid-directing means comprises a plurality of apertures extending through said central plate between said impeller passageways and said thrower passageways and a deflector ring having an arcuate cross-section extending downwardly from said central plate and radially outwardly of said apertures.

21. Apparatus according to claim 20 wherein said mixing apertures are disposed at a radial distance from said shaft of from about one-half to about three-fourths the radius of said central plate.

22. Apparatus according to claim 21 wherein said thrower vanes have a radial dimension substantially greater than the radial dimension of said impeller vanes, and said impeller vanes are disposed radially inwardly of said apertures.

23. Apparatus according to claim 15 wherein said thrower portion has a volume at least 120% greater than said impeller portion.

24. Apparatus according to claim 12 wherein said angle is between approximately 30° and approximately 60°.

25. Apparatus for mixing solid particles with a liquid comprising:

a housing having an outer peripheral space therein;

means for introducing solid particles into said housing;

means for introducing a liquid into said housing;

a shaft disposed for powered rotation within said housing;

an impeller assembly mounted upon said shaft for rotation within said housing, said peripheral space defined between said housing and said impeller assembly, and said impeller assembly having an upper solids thrower portion, a central plate between said thrower portion and said impeller portion, said thrower portion comprising a plurality of radially disposed thrower vanes defining at least one radial thrower passageway therebetween, and said impeller portion comprising a plurality of radially disposed impeller vanes defining at least one radial impeller passageway therebetween; and means for directing said liquid axially from said impeller portion to said thrower portion including means to establish liquid communication between said impeller passageways and said thrower passageways at a point radially inwardly of outer radial ends of said thrower vanes.

26. Apparatus according to claim 25 wherein said impeller assembly further comprises a cover plate in spaced parallel relation to said central plate, a bottom plate in spaced parallel relation to said central plate, and wherein said thrower vanes extend substantially perpendicularly between said cover plate and said central plate, and said impeller vanes extend substantially perpendicularly between said bottom plate and said central plate.

27. Apparatus according to claim 25 wherein said thrower portion has a volume at least 120% greater than the volume of said impeller portion.

28. Apparatus according to claim 25 wherein said thrower vanes have a radial extent substantially greater than the radial extent of said impeller vanes.

29. Apparatus according to claim 25 wherein said liquid-directing means includes an annular deflector ring disposed between said bottom plate and said central plate for redirecting liquid flowing radially in said impeller passageways in an axial direction through said apertures.

30. Apparatus according to claim 25 wherein said shaft is disposed at an angle from horizontal, and each of said thrower passageways has a radially interior entrance, and wherein said impeller assembly is rotatable to locate consecutively said interior entrance in substantially vertical alignment with said solid particles introducing means whereby solids fall by gravity from said solid particles introducing means through consecutive ones of said thrower passageways.

* * * * *